US009314807B2

(12) United States Patent
Croibier et al.

(10) Patent No.: US 9,314,807 B2
(45) Date of Patent: Apr. 19, 2016

(54) REFILLABLE FLUID DISPENSER

(71) Applicant: APTAR FRANCE SAS, Le Neubourg (FR)

(72) Inventors: Denis Croibier, Berou la Mulotiere (FR); Céline Raphanel, Pullay (FR)

(73) Assignee: APTAR FRANCE SAS, Le Neubourg (FR)

( * ) Notice: Subject to any disclaimer, the term of this patent is extended or adjusted under 35 U.S.C. 154(b) by 40 days.

(21) Appl. No.: 14/134,465

(22) Filed: Dec. 19, 2013

(65) Prior Publication Data

US 2014/0175129 A1 Jun. 26, 2014

Related U.S. Application Data

(60) Provisional application No. 61/762,583, filed on Feb. 8, 2013.

(30) Foreign Application Priority Data

Dec. 20, 2012 (FR) ..... 12 62495

(51) Int. Cl.
*G01F 11/00* (2006.01)
*B05B 11/00* (2006.01)

(52) U.S. Cl.
CPC ..... *B05B 11/0097* (2013.01); *B05B 11/0037* (2013.01); *B05B 11/0056* (2013.01); *B05B 11/3001* (2013.01)

(58) Field of Classification Search
CPC ..... B05B 11/0097; B05B 11/0056; B05B 11/3001
USPC ..... 222/321.1–321.9, 383.1, 383.3
See application file for complete search history.

(56) References Cited

U.S. PATENT DOCUMENTS

| | | | | |
|---|---|---|---|---|
| 3,357,603 | A * | 12/1967 | Kitabayashi | B65D 83/42 222/402.16 |
| 5,524,680 | A | 6/1996 | De Laforcade | |
| 7,866,513 | B2 * | 1/2011 | Leuliet | B05B 11/3004 222/321.7 |
| 7,882,988 | B2 * | 2/2011 | Nicolle | B05B 11/3004 222/321.9 |
| 2002/0175189 | A1 * | 11/2002 | Petit | B05B 11/3019 222/321.9 |
| 2003/0034362 | A1 * | 2/2003 | Blake | B05B 9/0883 222/321.9 |
| 2004/0211481 | A1 * | 10/2004 | Garcia | A61M 11/06 141/20 |
| 2007/0095861 | A1 * | 5/2007 | Yates | B05B 11/0018 222/323 |
| 2008/0035671 | A1 | 2/2008 | Foster | |

(Continued)

FOREIGN PATENT DOCUMENTS

WO 2011/026969 A1 3/2011

OTHER PUBLICATIONS

French Preliminary Search Report of FR 1262495, dated May 21, 2013.

*Primary Examiner* — Donnell Long
(74) *Attorney, Agent, or Firm* — Sughrue Mion, PLLC

(57) ABSTRACT

A refillable fluid dispenser comprising a fluid reservoir (1), a dispenser member (3), such as a pump, and a filler valve (2) for filling the fluid reservoir (1) once it is empty of fluid and full of air, the dispenser being characterized in that it further comprises air exhaust means (5, 6) for extracting the air from the fluid reservoir (1), and for creating therein suction for sucking the fluid through the filler valve (2) in its open state.

15 Claims, 3 Drawing Sheets

(56) References Cited

U.S. PATENT DOCUMENTS

2011/0309113 A1* 12/2011 Hui ..... B05B 11/0018
222/402.16
2012/0090730 A1* 4/2012 Dumont ..... A45D 34/02
141/2
2012/0160872 A1* 6/2012 Hsu ..... B05B 11/3008
222/321.1
2013/0126639 A1* 5/2013 Tu ..... B05B 11/0056
239/302
2014/0312144 A1* 10/2014 Hui ..... B05B 11/0056
239/302

* cited by examiner

REFILLABLE FLUID DISPENSER

CROSS REFERENCE TO RELATED APPLICATION

This application claims the benefit under 35 U.S.C. §119 (e) of U.S. provisional patent application Ser. No. 61/762,583, filed Feb. 8, 2013, and priority under 35 U.S.C. §119(a)-(d) of French patent application No. FR-12 62495, filed Dec. 20, 2012.

TECHNICAL FIELD

The present invention relates to a refillable fluid dispenser comprising a fluid reservoir, a dispenser member, such as a pump, and a filler valve for filling the fluid reservoir once it is empty of fluid and full of air. Advantageous fields of application of the present invention are the fields of perfumery, cosmetics, and pharmacy.

BACKGROUND OF THE INVENTION

In the prior art, document U.S. Pat. No. 5,524,680 is already known that describes a refillable dispenser comprising a fluid reservoir provided with a filler valve, and a pump that can be actuated by means of a pusher. When the pump has extracted the entire content of the reservoir, said reservoir is empty. That document does not make it clear whether the pump is an atmospheric pump (having air intake) or an airless pump (without air intake). Thus, when the reservoir is empty, it is either full of air if the pump is atmospheric, or it is subjected to suction (empty of air) if the pump is an airless pump. When the pump is an atmospheric pump, a source bottle provided with a pump is pressed against the filler valve in such a manner as to actuate the pump of the source bottle. Such actuation is repeated until the reservoir of the refillable dispenser is full.

In the prior art, document FR 2 854 131 is also known that describes a refillable dispenser comprising a reservoir and an airless pump. When all the fluid has been extracted from the reservoir by the airless pump, suction exists inside the reservoir. By connecting a source bottle to the reservoir through the airless pump, the suction in the reservoir sucks in the fluid contained in the source bottle. In other words, the suction in the reservoir serves as means for sucking through the airless pump, which pump has an outlet valve that acts as a filler valve.

Document EP 2 441 344 is also known that describes a refillable dispenser of the same type as the above-mentioned document U.S. Pat. No. 5,524,680, comprising an airless pump and a reservoir provided with a filler valve. The suction that exists inside the reservoir once empty is advantageously used to suck in fluid from a source bottle and through the filler valve.

Document EP 2 335 833 describes another type of refillable dispenser having a reservoir of volume that varies that is in the form of a bellows that is biased by a spring in such a manner as to create suction in the reservoir when it is empty. The suction is once again advantageously used to suck in fluid from a source bottle and through a filler valve. Document FR 2 959 729 also describes a refillable dispenser that operates on a similar principle.

As described above, two distinct types of refillable dispenser exist, namely a refillable dispenser having a reservoir that is at atmospheric pressure when it is empty, and a refillable dispenser having a reservoir that is under suction when it is empty. For a reservoir under suction, suction always results from extracting fluid by means of an airless pump, whether the reservoir is rigid or flexible. A recurring problem associated with the reservoir under suction resides in the fact that the suction in the reservoir tends to decrease or to disappear when the dispenser is not used for a certain period of time. In order to mitigate that problem, it is necessary to actuate the airless pump before proceeding with filling its reservoir, in order to recreate suction.

BRIEF SUMMARY OF THE INVENTION

An object of the present invention is the make the operation of filling the reservoir of a refillable dispenser easier, without using suction produced by extracting fluid from the reservoir. Another object of the present invention is to define a refillable dispenser that produces suction instantaneously, and simultaneously with the filling operation. Thus, the problem of maintaining the suction over time is completely avoided.

To do this, the present invention proposes that the dispenser further comprises air exhaust means for extracting the air from the fluid reservoir, and for creating therein suction for sucking the fluid through the filler valve in its open state. Unlike the refillable dispenser of the prior art having suction that results from extracting the fluid from the reservoir without air intake, the present invention uses exhaust means in order to extract the air (and not the fluid), in such a manner as to create instantaneous suction that leads to a concurrent operation of filling through the filler valve that is forced into its open state by the source bottle. The exhaust means of the dispenser are incorporated in the dispenser and thus form a part of it. It should also be understood that the air exhaust means are completely distinct from the dispenser member that has the function of extracting fluid from the fluid reservoir. Thus, during the operation of filling the reservoir through the filler valve, the air exhaust means have the effect of sucking the fluid into the reservoir from the source bottle.

Advantageously, the air exhaust means include an air chamber of volume that varies, which air chamber communicates with the reservoir through a suction check valve, and with the outside through an exhaust check valve. In this way, during its volume expansion stage, the air chamber extracts the air from the reservoir through the suction check valve, and during its volume reduction stage, it rejects the air contained therein to the outside through the exhaust check valve. The air chamber may also be referred to as an air pump making it possible to extract the air from the reservoir and to reject it to the outside. The air chamber may include a piston or a diaphragm, such as a bellows, for causing the volume of the air chamber to vary.

In an advantageous embodiment, the air chamber includes a flexible diaphragm that forms, at least in part, the suction check valve and the exhaust check valve. The flexible diaphragm that may be in the form of a bellows, may integrally form movable suction and exhaust members, e.g. in the form of flexible lips.

In a first embodiment of the invention, the air exhaust means include actuator means that are distinct from the filler valve. Advantageously, the dispenser member includes a pusher that is axially movable down and up, the actuator means being formed by the pusher. Preferably, the air exhaust means comprise a flexible diaphragm that extends between the pusher and a stationary element, the diaphragm internally defining an air chamber of volume that varies, the diaphragm being formed integrally both with a suction check valve lip that selectively closes a suction channel that connects the air chamber to the inside of the reservoir, and with an exhaust check valve lip that bears selectively in airtight manner against an exhaust valve seat. It can thus be said that the exhaust means are formed between the pusher and the reservoir and require only one additional part, namely the flexible diaphragm, and one additional characteristic, namely the suction channel that connects the air chamber to the inside of the reservoir.

According to another advantageous characteristic of the invention, the dispenser further comprises prevention means for preventing fluid from being dispensed while the reservoir is being filled by extracting the air contained therein by means of the exhaust means that are actuated by the pusher of the dispenser member. It is appropriate, indeed useful, to ensure that movement of the pusher for actuating the air chamber does not cause fluid to be dispensed. By way of example, it is possible to provide prevention means in the form of closure means for preventing the pump from being supplied with fluid, e.g. at the bottom end of the dip tube of the dispenser member. In a variant, the prevention means may comprise disengagement means for disengaging the pusher from the pump, such that actuating the pusher does not cause the pump to be actuated. By way of example, the disengagement means may be provided at the point at which the pusher is connected to the actuator or valve rod of the dispenser member.

In a general second embodiment, the exhaust means are actuated simultaneously with the filler valve. In a practical embodiment, the filler valve comprises a movable member that is for moving by an outlet nozzle of a source bottle, the movement of the movable member actuating the exhaust means. Advantageously, the exhaust means comprise a flexible diaphragm that extends between the movable member and a stationary element of the reservoir, the flexible diaphragm being formed integrally both with a suction check valve lip that selectively closes a suction channel that connects the air chamber to the inside of the reservoir, and with an exhaust check valve lip that bears selectively in airtight manner against an exhaust valve seat. Advantageously, the movable member is resiliently biased into its closed rest position by the exhaust means.

In a variant, the exhaust means include a piston that is formed by the movable member, the piston causing the volume of the air chamber to vary, the piston forming the exhaust check valve. In this second embodiment in which the exhaust means are actuated simultaneously with the filler valve, the user who fills the refillable dispenser is not even conscious or aware that said refillable dispenser is provided with air exhaust means making it possible to suck the fluid into the reservoir of the refillable dispenser. When the user presses the source bottle against the filler valve, said filler valve opens and fluid under pressure is injected into the reservoir, and when the user relaxes the pressure on the filler valve, the suction means create suction in the reservoir that causes fluid to be sucked from the source bottle until the filler valve is closed. Thus, it can be considered that the air exhaust means perform a function of enhancing filling by adding additional or complementary suction to conventional fluid injection.

The spirit of the invention resides in creating suction in the reservoir by exhaust means that are situated outside the reservoir and that are distinct from the dispenser member (pump), the suction being created simultaneously or concurrently with the operation of filling the reservoir through the filler valve that is forced into its open state. The exhaust means may be incorporated in the dispenser member, such that the pusher of the dispenser member also acts as actuator means for the air exhaust means. The air exhaust means may also be associated with, or incorporated in, the filler valve, such that the actuation of the filler valve also serves as actuator means for the air exhaust means, which may themselves serve as a return spring for the filler valve.

BRIEF DESCRIPTION OF THE DRAWINGS

The invention is described more fully below with reference to the accompanying drawings which show two embodiments of the invention and a few variants by way of non-limiting example.

In the figures.

DETAILED DESCRIPTION

Figure 1:
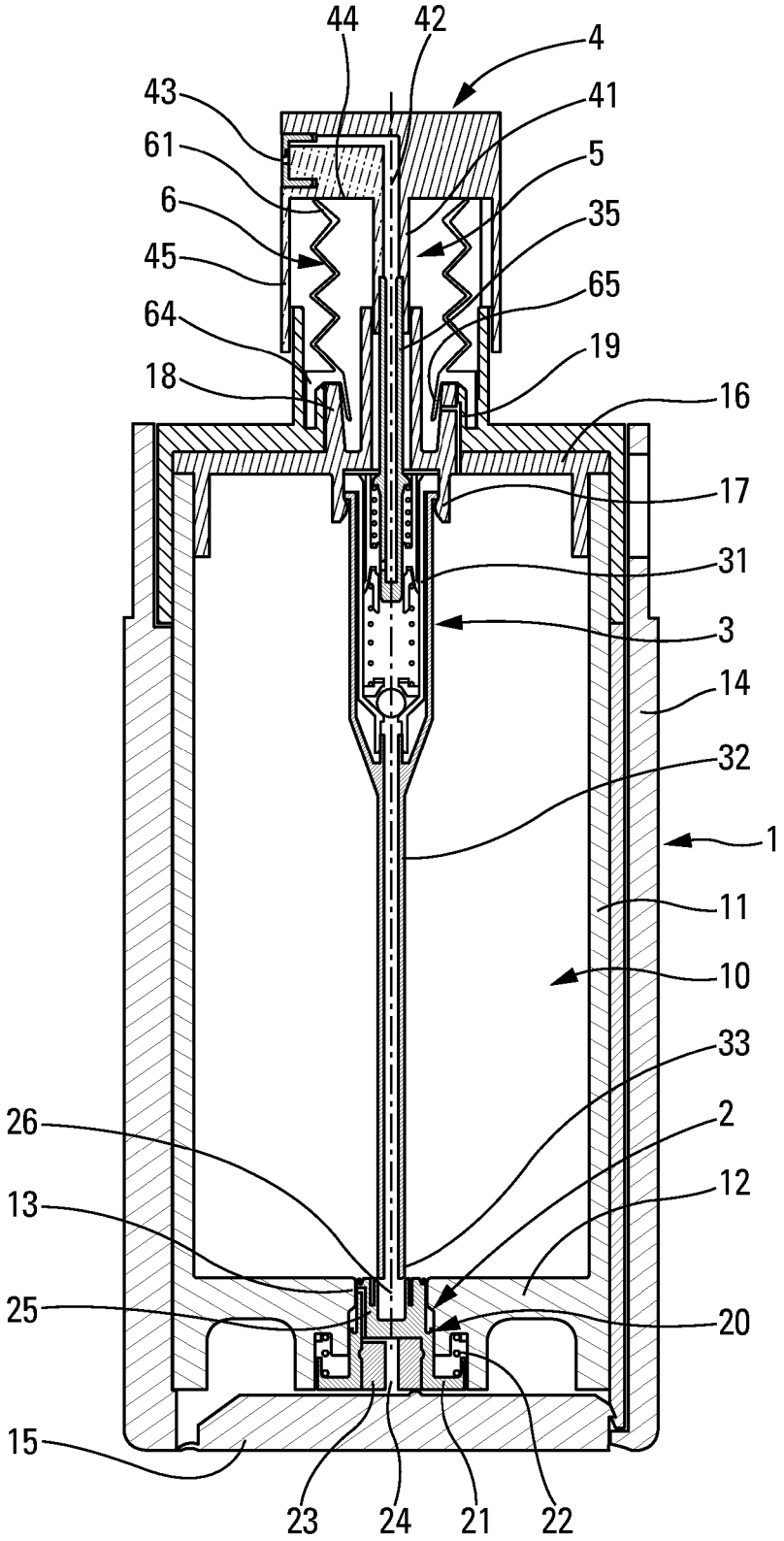
FIG. 1 is a vertical section view through a refillable dispenser in a first embodiment of the invention, in its rest state.

In the first embodiment and in conventional manner, the refillable dispenser of the invention comprises a fluid reservoir 1, a filler valve 2, a fluid dispenser member 3, and a pusher 4. All of the component elements may be completely conventional, like those of the refillable dispenser in document U.S. Pat. No. 552,468.

However, in this first embodiment, the fluid reservoir 1 presents a particular design resulting from combining several elements. Amongst other things, the fluid reservoir 1 includes an inner container 11 that includes a bottom 12 that is provided with an opening that forms a valve seat 13. The inside 10 of the container 11 constitutes the working volume of the reservoir, which working volume is filled with fluid, such as perfume. At its top end, the container 11 is provided with a top 16 that forms a fastener collar 17 for fastening the dispenser member 3, and an annular flange 18 having a function that is explained below. Furthermore, the container 11 is surrounded by an outer shell 14 that is provided at its bottom end with a cover 15 that is hinged in such a manner as to be capable of covering and uncovering the bottom 12 of the container 11. The reservoir 1 may also include other component elements that are not described in detail. Naturally, instead of this particular reservoir, it is possible to use any reservoir on which it is possible to mount a filler valve 2 and a dispenser member 3.

The filler valve 2 that is mounted in the bottom 12 of the container 11 is essentially constituted by a movable valve member 20 that is biased into a rest position by a return spring 22. Very conventionally, when the outlet nozzle of a source bottle is pressed against the movable member 20, said movable member moves against the force of the return spring 22 in such a manner as to uncover a fluid passage that communicates with the inside 10 of the reservoir 1. This design is entirely conventional for a filler valve of a refillable dispenser. In greater detail, the movable member 20 comprises: a bushing 21 that is engaged directly by the return spring 22; a flexible ring 23 for coming into leaktight contact with the free end of the outlet nozzle S of the source bottle; a central duct 24 that is formed in the flexible ring 23; and a closure dish 25 that internally forms a closure housing 26 having a function that is explained below. The central duct 24 opens out sideways, and in the rest position shown in FIG. 1, it is closed by the valve seat 13 formed by the bottom 12 of the container 11. From FIG. 1, it can easily be understood that moving the movable member 20 against the spring 22 makes it possible to uncover the side orifice of the valve in such a manner as to be arranged on the inside 10 of the reservoir 1. Except for the closure housing 26, the filler valve 2 is of an entirely conventional type.

The dispenser member 3 is preferably an air-intake pump. The dispenser member 3 includes a body 31 in which there is formed a chamber that is provided with an inlet valve and with an outlet valve. The body 31 is held stationary in the fastener collar 17 that is formed by the top 16. The dispenser member 3 also includes an actuator rod 35 that is axially movable down and up inside the pump body 31, so as to cause the volume of the chamber to vary. By driving the actuator rod 35 into the body 31, fluid under pressure is forced through the rod 35. In addition, the dispenser member 3 also includes a dip tube 32 that extends inside the reservoir into the proximity of the closure dish 25. In the context of the invention, it is preferable for the dip tube 32 to be accurately centered on the closure housing 26 for reasons that are explained below.

The pusher 4 is provided with a connection sleeve 41 that is engaged on the free end of the actuator rod 35 of the dispenser member 3. The connection sleeve 41 internally defines an outlet channel 42 that joins a dispenser orifice 43, e.g. in the form of a nozzle. The pusher 4 defines a bottom annular wall 44 that extends around the connection sleeve 41. The pusher 4 also defines a cylindrical skirt 45 that extends downwards from the outer periphery of the bottom annular wall 44. This design is entirely conventional for a pusher in the fields of perfumery, cosmetics, and pharmacy. By pressing manually on the pusher 4 with one or more fingers, it is moved in such a manner as to drive the actuator rod 35 into the body 31 of the dispenser member 3. In response, fluid under pressure is forced through the actuator rod 35 and the outlet duct 42 and is finally dispensed through the dispenser orifice 43. This operation is entirely conventional for a dispenser member provided with a pusher in the fields of perfumery, cosmetics, and pharmacy.

In the invention, the refillable dispenser is further provided with air exhaust means 5, 6 having the function of extracting air from the fluid reservoir 1 so as to create therein suction that makes it possible to suck fluid through the filler valve 2 that is forced into its open state. The air exhaust means are incorporated in the refillable dispenser, and not merely associated therewith. The air exhaust means are preferably housed inside the refillable dispenser as defined above. It should also be observed that the air exhaust means are not constituted by the dispenser member 3 that has the function of extracting fluid, and not air, from the fluid reservoir 1. The air exhaust means alone may make it possible to fill the fluid reservoir, or, in a variant, they may facilitate or enhance the fluid injection capacity of the source bottle that is connected to the filler valve 2.

In the first embodiment of the invention, the air exhaust means are in the form of a flexible diaphragm 6 that internally defines an air chamber of volume that varies. By way of example, the flexible diaphragm 6 may be in the form of a bellows that has a plurality of folds and that is arranged between the pusher 4 and the reservoir 1. More precisely, the flexible diaphragm 6 is arranged inside the skirt 45 of the pusher 4 around the actuator rod 35 and the connection sleeve 41. In its bottom portion, the flexible diaphragm 6 includes an anchor band 64 that is engaged around the flange 18 of the top 16. Internally, the diaphragm 6 forms a flexible lip 65 that bears in selective and airtight manner against the inner wall of the flange 18 that forms a suction channel 19 that connects the inside of the air chamber 5 to the inside 10 of the reservoir 1. In this embodiment, the suction channel 19 passes through the wall thickness of the flange 18, passes along the outside of the flange 18, and passes through the wall thickness of the top 16 so as to open out into the inside 10 of the reservoir 1. At its opposite top end, the flexible diaphragm 6 forms a flexible lip 61 that bears against the bottom annular wall 44 of the pusher 4. The lip 65 that bears selectively in airtight manner against the flange 18 forms a movable suction valve member, while the lip 61 that bears selectively in airtight manner against the wall 44 forms a movable exhaust valve member.

In the rest position shown in FIG. 1, the volume of the air chamber 5 is at its maximum. The pressure that exists therein is substantially equal to the pressure of the reservoir 1 which is at atmospheric pressure when the dispenser member 3 is an air-intake pump.

It is possible to use the FIG. 1 refillable dispenser in an entirely conventional manner by pressing on the pusher 4 in such a manner as to dispense successive doses of fluid through the dispenser orifice 43. The dispenser member 3 extracts fluid from the reservoir 1 through its dip tube 32, its pump chamber, and its actuator rod 35 that is connected to the pusher 4. Dispensing may continue until the reservoir is empty. Even if the air exhaust means 5, 6 exhaust the air from the reservoir as the fluid is extracted therefrom, no suction is established given that the dispenser member 3 makes it possible, on each actuation, to connect the inside of the reservoir with the outside, in such a manner as to return the reservoir to atmospheric pressure.

When the user wishes to re-fill the reservoir of the refillable dispenser, the user begins by opening the cover 15 so as to uncover the bottom 12 and its filler valve 2. The user then applies the flexible ring 23 against the outlet nozzle S of a source bottle that is provided with a pump. By pressing the reservoir 1 against the outlet nozzle S, the filler valve 2 opens, thereby creating a passage that enables the fluid from the outlet nozzle S to reach the inside 10 of the reservoir. The refillable dispenser of the invention may be moved down and up several times so as to inject successive doses of fluid into its reservoir. Conventional filling is thus performed.

However, in the invention, the filling operation may be amplified or enhanced by the air exhaust means of the invention. By pressing on the pusher 4, the flexible diaphragm 6 is deformed and the internal volume of the air chamber 5 is reduced. The air under pressure contained therein cannot be exhausted towards the reservoir through the suction channel 19 that is closed in airtight manner by the lip 65 that is pressed against the inlet of the channel 19 by the pressure that exists in the air chamber 5. In contrast, the air can escape to the outside at the top lip 61 where its airtight contact with the bottom annular wall 44 is broken by the presence of one or more spikes 63 formed by the lip 61. Deforming the flexible diaphragm 6 causes the lip 61 to pivot against the wall 44, such that the spikes 63 move back into contact with the wall 44 and thus break the airtight contact with the wall 44 that was established by the free end 62 of the lip 61. This can be seen more clearly in FIG. 3. The air chamber 5 then presents a minimum volume.

Figure 4A:
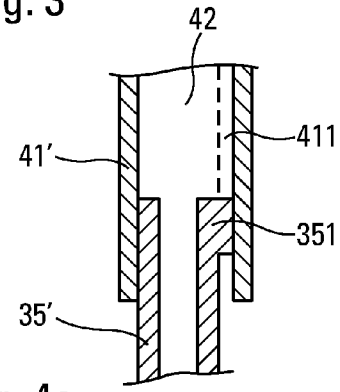
FIGS. 4*a* and 4*b* are very diagrammatic views showing a variant of the first embodiment.
Figure 4B:
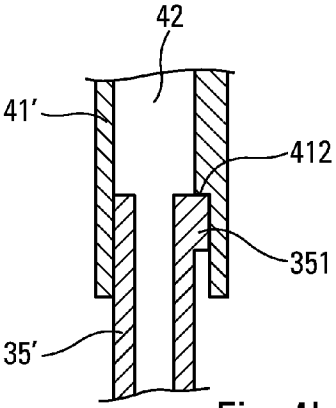
Figure 2:
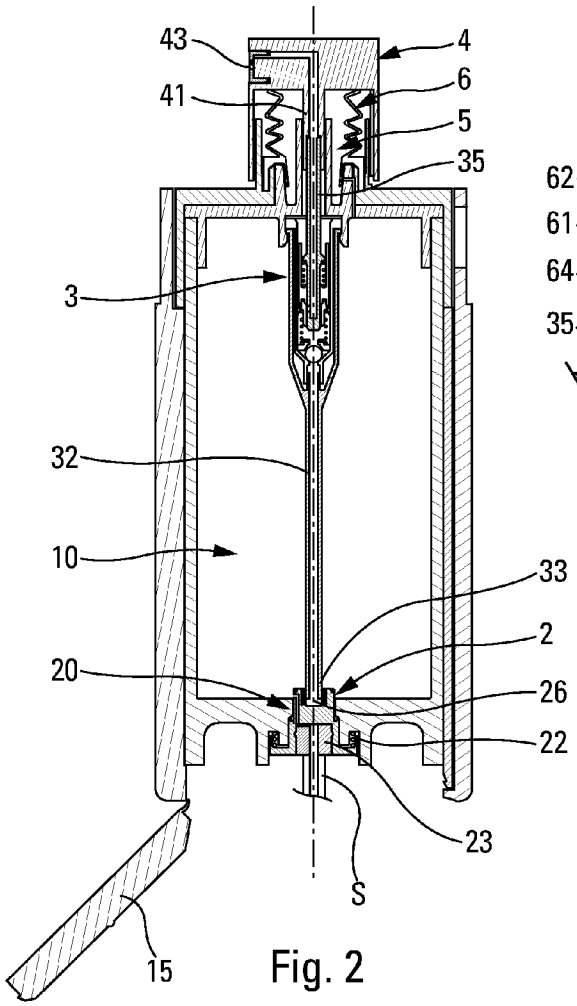
FIG. 2 is a view similar to the view in FIG. 1 during an operation of filling the reservoir.

Naturally, by fully depressing the pusher 4, the filler valve 2 is forced into its open state as a result of its bearing contact against the outlet nozzle S, as can be seen in FIG. 2. This causes the free end 33 of the dip tube 32 to be engaged in the closure housing 26 formed by the closure dish 25 of the filler valve 2. Communication is thus broken between the inside 10 of the reservoir and the dip tube 32, such that the dispenser member 3 is no longer fed with fluid. Thus, even if the actuator rod 35 is moved in the body 31 of the dispenser member 3, it is not possible for any fluid to be dispensed at the dispenser orifice 43, given that the dispenser member is no longer fed with fluid. Consequently, the closure dish with its housing 26 act as prevention means for preventing fluid from being dispensed while the reservoir is being filled through the filler valve 2 that is forced into its open state. Another embodiment of such prevention means for preventing fluid from being dispensed is shown in FIGS. 4*a* and 4*b*. By way of example, provision may be made to disengage the pusher 4 from the dispenser member 3 at the point where they connect. More concretely, the actuator rod 35' may be provided with an abutment stud 351, and the connection sleeve 41' may be provided with a slide groove 411 in which the abutment stud 351 may slide. Thus, the connection sleeve 41' may slide around the actuator rod 35' without driving it in. In contrast, by turning the pusher 4 over a determined angular stroke, e.g. one fourth of a turn, it is possible to bring the abutment stud 351 against an inner shoulder 412 of the connection sleeve 41'. In this position, moving the connection sleeve 41' causes the actuator rod 35' to be actuated in conventional manner. In both of the above-described embodiments, prevention means for preventing fluid from being dispensed make it possible to actuate the pusher 4 without fluid being dispensed.

Figure 3:
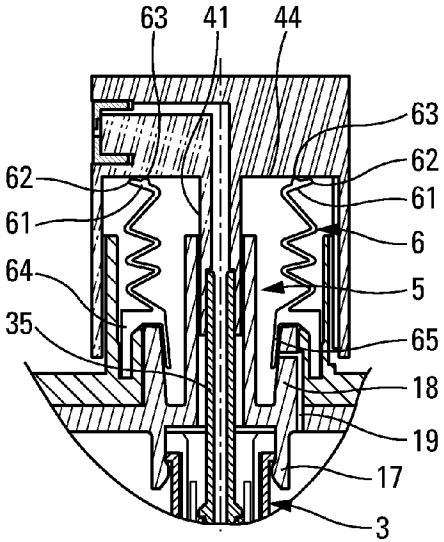
FIG. 3 is a greatly enlarged view of the top portion of FIG. 2.

From the depressed position shown in FIG. 3, the user may relax the pressure on the pusher 4, such that the volume of the air chamber 5 increases. The air penetrates into the chamber 5 through the suction duct 19, since its inlet is no longer closed by the lip 65 that has been lifted off by the suction existing in the chamber 5. At its top end, the free end 62 of the lip 61 is once again in airtight contact with the wall 44: the spikes 63 no longer being in contact with the wall 44. Air from the reservoir may thus be sucked into the air chamber 5, thereby creating suction inside the reservoir 1. The suction makes it possible to suck the fluid from the source bottle through its outlet nozzle S and the filler valve 2 that is forced into its open state. In some circumstances, it may even be envisaged to match the volume of the air chamber 5 to the volume of the reservoir 1, such that a single actuation of the pusher suffices to fill the reservoir completely. In this circumstance, the air exhaust means ensure the reservoir is filled, practically on their own.

Figure 7:
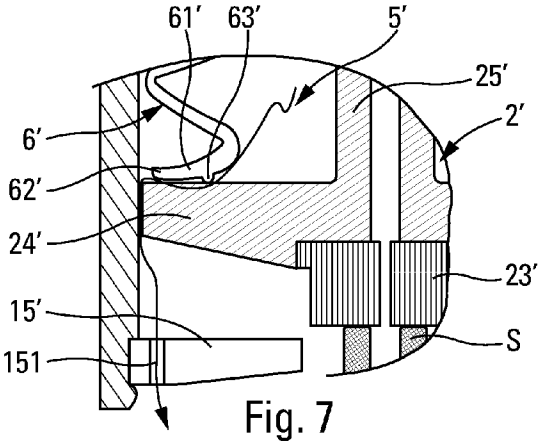
FIG. 7 is a greatly enlarged view of a detail of FIG. 6.
Figure 6:
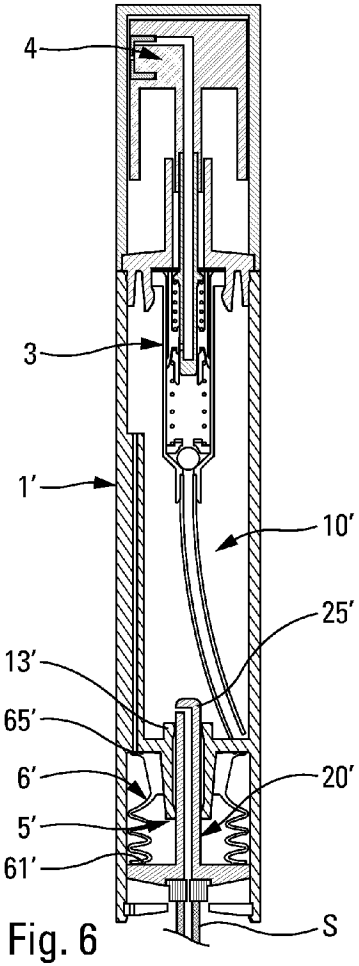
FIGS. 5 and 6 are vertical section views of a second embodiment of the invention, respectively in the rest state and during filling.
Figure 5:
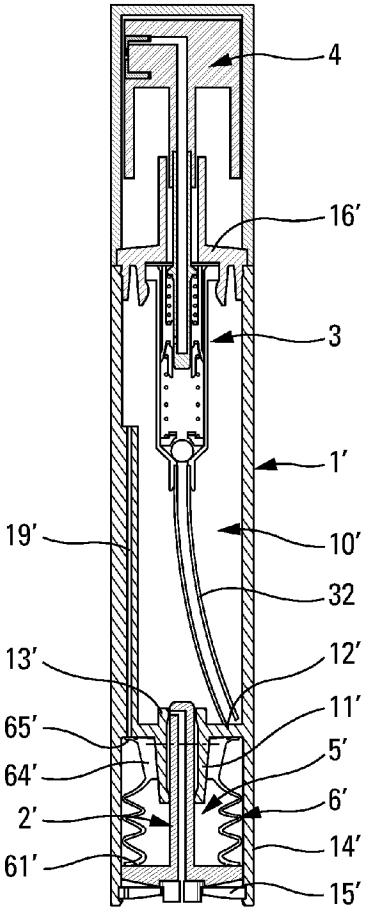

Reference is made below to FIGS. 5, 6, and 7 in order to describe a second embodiment of the invention. The component elements of this refillable dispenser that perform the same functions as in the first embodiment are designated by the same numerical references, however those references include primes when the structure of an element differs from its structure in the first embodiment. Thus, the refillable dispenser in this second embodiment also includes a dispenser member 3 that may be an air-intake pump, and a pusher. By way of example, the dispenser member 3 may be mounted in a top 16', as in the first embodiment. The fluid reservoir 1' also includes a bottom 12' that forms a filler valve seat 13'. The reservoir 1' further forms a guide sleeve 11' and a sheath 14'. The reservoir 1' also forms an air suction channel 19' that may be incorporated in the wall thickness of the reservoir. The suction channel 19' extends from the bottom 12 up to the height of the dispenser member 3. The suction channel 19' thus extends over a major fraction of the height of the reservoir 1'.

The filler valve 2', more visible in FIG. 7, comprises a movable member 20' that is formed by a rod 25' that extends from a disk 24' that is provided with a flexible ring 23' that is adapted to come into leaktight contact with the free end of an outlet nozzle S of a source bottle. At rest, the movable member 20' abuts against a washer 15' that is mounted inside the sheath 14'. The washer 15' is provided with a vent hole 151 that puts the inside of the sheath 14' into communication with the outside. The rod 25' includes a side orifice that is covered in the rest position by the valve seat 13', as can be seen in FIG. 5. In contrast, when the flexible ring 23' is pressed by means of the outlet nozzle S of a source bottle, the rod 25' moves inside the reservoir 1', such that its side orifice is uncovered completely. This can be seen in FIG. 6. The movable member may be biased into its rest position in FIG. 5 by a conventional return spring. In the invention, in this embodiment, the spring means are constituted by a flexible diaphragm 6' that forms an air chamber 5'. The flexible diaphragm 6' that is substantially similar to the flexible diaphragm 6 of the first embodiment comprises an anchor band 64' that is engaged around the guide sleeve 11', a flexible suction lip 65' that closes the suction channel 19', and an exhaust lip 61' that includes an airtight-contact end 62' and one or more spikes 63' for breaking the airtight contact by pivoting the lip. In this embodiment, the lip 61' comes into contact with the disk 24' of the movable member. This is shown more clearly in FIG. 7. In the rest position in FIG. 5, the internal volume of the air chamber 5' is at its maximum. By moving the movable member as shown in FIG. 6 by means of the outlet nozzle S of a source bottle, not only is the filler valve forced into its open state, but the internal volume of the air chamber 5' also reduces. The air contained therein is exhausted to the outside at its lip 61' since its spikes 63' have broken the airtight contact. The air of the chamber may thus be exhausted to the outside as shown by the arrow in FIG. 7. The air passes around the disk 24', then passes through the vent hole 151 that is formed in the washer 15'. When the pressure on the movable member of the filler valve is relaxed, leaktight contact is still established between the flexible ring 23' and the outlet nozzle S, but the air from the reservoir is sucked through the suction channel 19' until it reaches the air chamber 5' through the lip 65'. Thus, the suction that has been created inside the reservoir 1' makes it possible to suck the fluid from the source bottle until the rod 25' returns to its leaktight rest position shown in FIG. 5. In other words, fluid is injected under pressure through the rod 25' when the outlet nozzle S pushes the rod inside the reservoir, and fluid is sucked through the outlet nozzle S and the rod 25' when said rod returns to its leaktight rest position. The go and return strokes of the rod 25' are thus advantageously used to insert fluid into the reservoir by injection on the go stroke and by suction on the return stroke. Provision may thus be made for the filler valve to be actuated only once in order to fill the fluid reservoir completely. The air exhaust means make it possible to increase considerably the amount of fluid injected.

Figure 8:
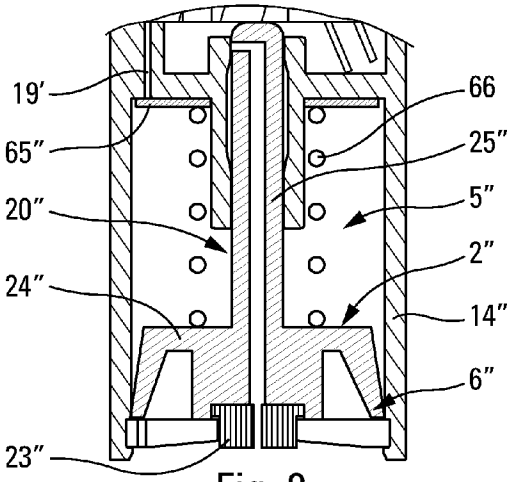
FIG. 8 shows a variant of the second embodiment.

FIG. 8 shows a variant embodiment in which the flexible diaphragm 6' has been replaced by a piston 6" that is formed by the movable member 20" of the filler valve 2". The rod 25" may be identical to the rod 25'. An additional return spring 66 is naturally necessary. In this embodiment, the suction valve is formed by a flexible annular gasket 65" that closes the outlet of the suction channel 19' in selective and airtight manner. It should be observed that the piston 6" also forms the exhaust check valve, enabling the air that is present in the air chamber 5" to leak to the outside. In contrast, when the chamber 5" is under suction, the piston is airtight, and the air from the reservoir is sucked through the suction channel 19' and the open suction valve 65".

It should be observed that the flexible diaphragm 6 of the first embodiment may also be replaced by a leaky piston, such as the piston in FIG. 8.

Whether the air exhaust means use a flexible diaphragm 6, 6' or a leaky piston 6", they define an air chamber 5, 5', or 5"

that is provided with a suction check valve 65, 65', 65" and with an exhaust check valve 61, 61', 6". When the air exhaust means are incorporated in the pusher, it is preferable to provide prevention means for preventing fluid from being dispensed. The pusher 4 thus serves as actuator means for the air exhaust means. When the air exhaust means are associated with, or incorporated in, the filler valve, said filler valve serves as actuator means for the air exhaust means. In addition, the air exhaust means may be used as a return spring for the filler valve.

By means of the invention, a refillable dispenser is obtained that has air exhaust means incorporated therein that can be actuated by the pusher or by the filler valve, and that make it possible to increase or enhance the amount of fluid delivered by the source bottle.

What is claimed is:

1. A refillable fluid dispenser comprising a fluid reservoir (1), a dispenser member (3), and a filler valve (2; 2'; 2") for filling the fluid reservoir (1) once it is empty of fluid and full of air, the dispenser being characterized in that it further comprises air exhaust means (5; 5'; 5", 6; 6'; 6") for extracting the air from the fluid reservoir (1), and for creating therein suction for sucking the fluid through the filler valve (2; 2'; 2") in its open state.

2. A dispenser according to claim 1, wherein the air exhaust means include an air chamber (5; 5'; 5") of volume that varies, which air chamber communicates with the reservoir (1) through a suction check valve (65; 65'; 65"), and with the outside through an exhaust check valve (61; 61'; 6").

3. A dispenser according to claim 2, wherein the air chamber (5; 5') includes a flexible diaphragm (6; 6') that forms, at least in part, the suction check valve (65; 65') and the exhaust check valve (61; 61').

4. A dispenser according to claim 1, wherein the air exhaust means (5, 6) include actuator means (4) that are distinct from the filler valve (2).

5. A dispenser according to claim 4, wherein the dispenser member (3) includes a pusher (4) that is axially movable down and up, the actuator means being formed by the pusher (4).

6. A dispenser according to claim 5, wherein the air exhaust means (5; 6) comprise a flexible diaphragm (6) that extends between the pusher (4) and a stationary element (18), the diaphragm (6) internally defining an air chamber (5) of volume that varies, the diaphragm (6) being formed integrally both with a suction check valve lip (65) that selectively closes a suction channel (19) that connects the air chamber (5) to the inside (10) of the reservoir (1), and with an exhaust check valve lip (61) that bears selectively in airtight manner against an exhaust valve seat (44).

7. A dispenser according to claim 5, including prevention means (26) for preventing fluid from being dispensed while the reservoir (1) is being filled by extracting the air contained therein by means of the exhaust means (5, 6) that are actuated by the pusher (4) of the dispenser member (3).

8. A dispenser according to claim 7, wherein the prevention means comprise closure means (26) for preventing the dispenser member (3) from being supplied with fluid.

9. A dispenser according to claim 7, wherein the prevention means comprise disengagement means (351, 411, 412) for disengaging the pusher (4) from the dispenser member (3), such that actuating the pusher (4) does not cause the dispenser member (3) to be actuated.

10. A dispenser according to claim 1, wherein the exhaust means (5'; 5", 6'; 6") are actuated simultaneously with the filler valve (2'; 2").

11. A dispenser according to claim 10, wherein the exhaust means (5"; 6") include a piston (6") that is formed by the movable member (20"), the piston (6") causing the volume of the air chamber (5") to vary, the piston (6") forming the exhaust check valve.

12. A dispenser according to claim 10, wherein the filler valve (2'; 2") comprises a movable member (20'; 20") that is for moving by an outlet nozzle (S) of a source bottle, the movement of the movable member (2'; 2") actuating the exhaust means (5'; 5", 6'; 6").

13. A dispenser according to claim 12, wherein the exhaust means (5'; 6') comprise a flexible diaphragm (6') that extends between the movable member (20') and a stationary element (11') of the reservoir (1'), the flexible diaphragm (6') being formed integrally both with a suction check valve lip (65') that selectively closes a suction channel (19') that connects the air chamber (5') to the inside (10') of the reservoir (1'), and with an exhaust check valve lip (61') that bears selectively in airtight manner against an exhaust valve seat (24').

14. A dispenser according to claim 12, wherein the movable member (20') is resiliently biased into its closed rest position by the exhaust means (5'; 6').

15. A dispenser according to claim 1, wherein the dispenser member is a pump.

* * * * *